US011394097B2

(12) United States Patent
Bulja et al.

(10) Patent No.: US 11,394,097 B2
(45) Date of Patent: Jul. 19, 2022

(54) COMPOSITE SUBSTRATE FOR A WAVEGUIDE AND METHOD OF MANUFACTURING A COMPOSITE SUBSTRATE

(71) Applicant: Nokia Solutions and Networks Oy, Espoo (FI)

(72) Inventors: Senad Bulja, Dublin (IE); Rose Fasano Kopf, Green Brook, NJ (US); Pawel Rulikowski, Clonsilla (IE); Majid Norooziarab, Dublin (IE)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 169 days.

(21) Appl. No.: 16/611,056

(22) PCT Filed: Apr. 27, 2018

(86) PCT No.: PCT/EP2018/060822
§ 371 (c)(1),
(2) Date: Nov. 5, 2019

(87) PCT Pub. No.: WO2018/202560
PCT Pub. Date: Nov. 8, 2018

(65) Prior Publication Data

US 2020/0127357 A1 Apr. 23, 2020

(30) Foreign Application Priority Data

May 5, 2017 (EP) ..... 17169665

(51) Int. Cl.
*H01P 3/08* (2006.01)
*H01P 11/00* (2006.01)

(52) U.S. Cl.
CPC ..... *H01P 3/082* (2013.01); *H01P 3/081* (2013.01); *H01P 11/003* (2013.01)

(58) Field of Classification Search
CPC ..... H01P 1/302; H01P 11/003; H01P 3/082; H01P 3/12; H03H 2001/0085
(Continued)

(56) References Cited

U.S. PATENT DOCUMENTS 5,329,263 A 7/1994 Minami
5,568,106 A 10/1996 Fang et al.
(Continued)

FOREIGN PATENT DOCUMENTS

CN 1425555 A 6/2003
CN 101005150 A 7/2007
(Continued)

OTHER PUBLICATIONS

Office Action received for corresponding European Patent Application No. 17169665.1, dated Mar. 20, 2020, 8 pages.
(Continued)

*Primary Examiner* — Rakesh B Patel
(74) *Attorney, Agent, or Firm* — Mendelsohn Dunleavy, P.C.; Yuri Gruzdkov; Steve Mendelsohn

(57) ABSTRACT

Composite substrate for a waveguide for RF signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 120 percent of a skin depth of said RF signals within said electrically conductive material of said conductor layer.

24 Claims, 3 Drawing Sheets

(58) Field of Classification Search
USPC ..... 333/185, 204, 205
See application file for complete search history.

(56) References Cited

U.S. PATENT DOCUMENTS

| | | | | |
|---|---|---|---|---|
| 2003/0112092 | A1* | 6/2003 | Kitamori ..... | H01P 3/165 333/81 B |
| 2015/0282299 | A1 | 10/2015 | Shi et al. | |

FOREIGN PATENT DOCUMENTS

| | | | |
|---|---|---|---|
| CN | 104767014 | A | 7/2015 |
| EP | 1988596 | A1 | 11/2008 |

OTHER PUBLICATIONS

Chen, "Semiconductor Activated Terahertz Metamaterials", Frontiers of Optoelectronics, vol. 8, No. 1, 2015, pp. 27-43.
Gonçalves, "Plasmonic Nanoparticles: Fabrication, Simulation and Experiments", Journal of Physics D: Applied Physics, vol. 47, No. 21, May 9, 2014, pp. 1-44.
Extended European Search Report received for corresponding European Patent Application No. 17169665.1, dated Nov. 8, 2017, 7 pages.
Zhang et al., "Dispersion Characteristics of Multilayer Microstrip Lines With Thin Metal Ground", IEEE Antennas and Propagation Society International Symposium, Jul. 3-8, 2005, pp. 642-645.
International Search Report and Written Opinion received for corresponding Patent Cooperation Treaty Application No. PCT/EP2018/060822, dated Jul. 27, 2018, 12 pages.
Office Action received for corresponding Chinese Patent Application No. 201880038495 3, dated Jan. 12, 2021,6 pages of office action and 6 pages of Translation available.
Oral proceedings received for corresponding European Patent Application No. 17169665.1, dated Jun. 16, 2021, 2 pages.
Bloemer et al., "Laminated Photonic Band Structures with High Conductivity and High Transparency", IEEE MTT-S International Microwave Symposium Digest, Jun. 13-19, 1999, pp. 893-896.
Second Office Action for corresponding Chinese application No. 201880038495.3; dated Jul. 7, 2021 (14 pages) Machine Translation.
Lukashevich, Dzianis, et al. "Numerical Investigation of Transmission Lines and Components in Damascene Technology." 2002 32nd European Microwave Conference. IEEE. Milan, Italy. (2002): 1-4.
Zhuang, Yan, et al. "Magnetic-Multilayered Interconnects Featuring Skin Effect Suppression." IEEE Electron Device Letters 29.4 (2008): 319-321.
Third Office Action for corresponding Chinese application No. 201880038495.3; dated Jan. 7, 2022 (10 pages) Machine Translation.
Cregut, C., et al. "High frequency modeling of interconnects in deep-submicron technologies." Proceedings of the EEE 1999 International Interconnect Technology Conference (Cat. No. 99EX247), San Francisco, CA, USA (1999) 71-73.

* cited by examiner

Fig. 6
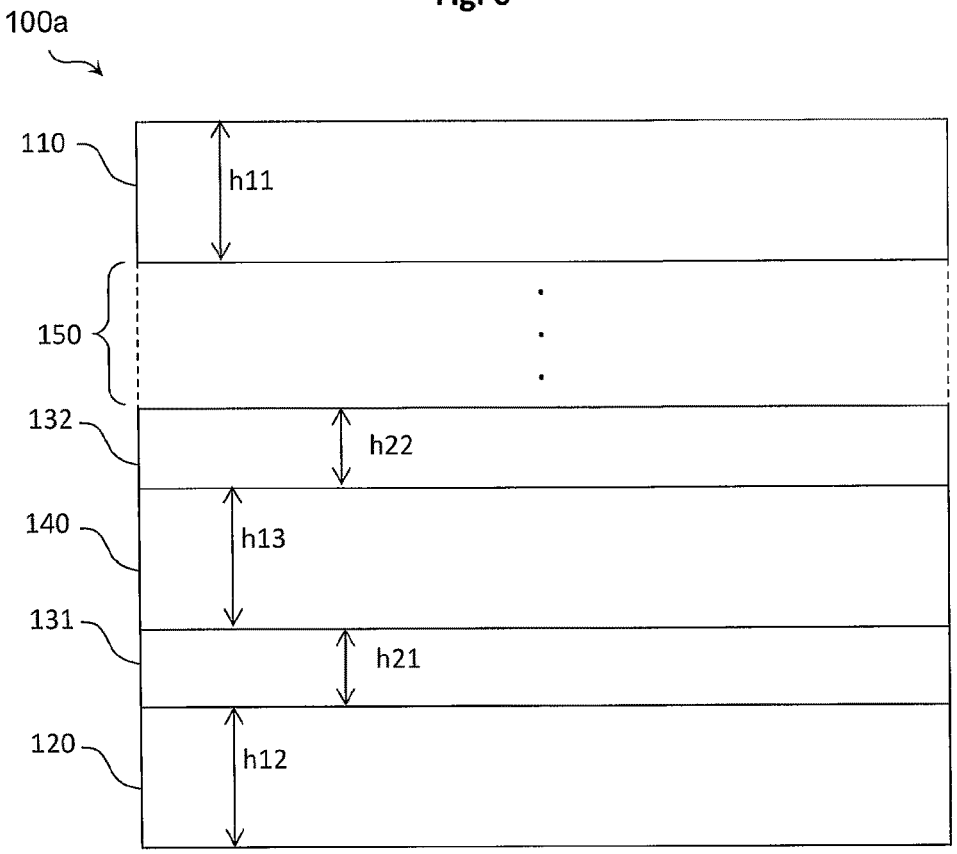
Fig. 7
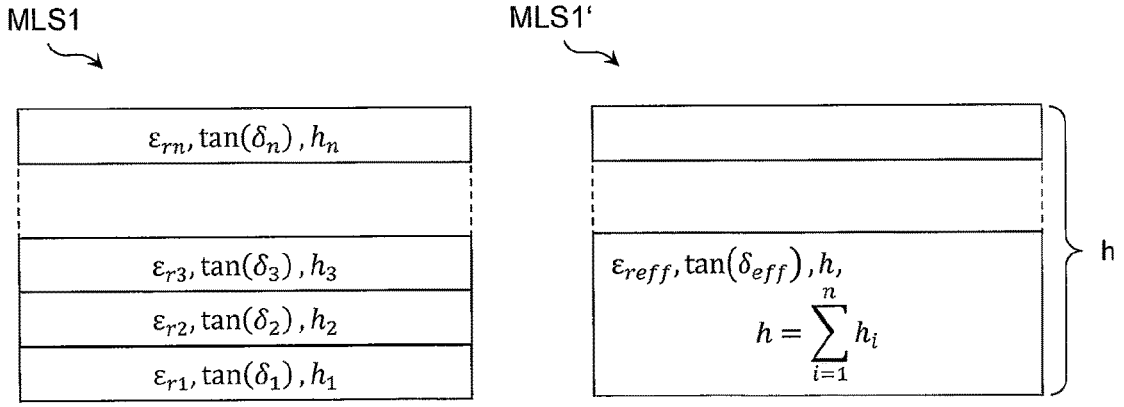
Fig. 8
| f | Aluminium (Al) $\sigma = 3.5 \times 10^7$ | Copper (Cu) $\sigma = 5.96 \times 10^7$ | Silver (Ag) $\sigma = 6.3 \times 10^7$ |
|---|---|---|---|
| 1GHz | $3.147 \times 10^8$ | $5.36 \times 10^8$ | $5.667 \times 10^8$ |
| 5 GHz | $6.296 \times 10^7$ | $1.072 \times 10^8$ | $1.133 \times 10^8$ |
| 20 GHz | $1.574 \times 10^7$ | $2.68 \times 10^7$ | $2.833 \times 10^7$ |

COMPOSITE SUBSTRATE FOR A WAVEGUIDE AND METHOD OF MANUFACTURING A COMPOSITE SUBSTRATE

RELATED APPLICATION

This application was originally filed as Patent Cooperation Treaty Application No. PCT/EP2018/060822 filed Apr. 27, 2018 which claims priority benefit to European Application No. 17169665.1, filed May 5, 2017.

FIELD OF THE INVENTION

The disclosure relates to a composite substrate for a waveguide for radio frequency (RF) signals. The disclosure further relates to a method of manufacturing a composite substrate for a waveguide for RF signals.

BACKGROUND

Conventional single layer substrate materials for RF waveguides such as microstrip lines and the like are usually offered by their manufacturers in a standard set of dielectric properties, e.g. with values for the relative permittivity ($\varepsilon_r$) from 2-10. This limitation is dictated by the cost associated with the development of substrates with custom values of their dielectric and electrical characteristics. Disadvantageously, this forces RF designers to choose a suitable substrate for their design not on the basis of "the best suited substrate", but on the basis of "the least worst substrate" for a particular design.

This problem is somewhat ameliorated by the use of multi-layered RF dielectric substrates, where different thicknesses of constituent substrates, or layers, are stacked together in order to obtain "effective" dielectric properties of the multi-layered substrate, suitable for a particular design/project. Even though this approach may be effective in the development of a certain range of usable dielectric substrates, it places stringent constraints on the availability of the constitutive substrates, which increases production cost. Further, conventional multi-layered substrates obtained in this way are limited by the obtainable values of the dielectric permittivity which is dictated by the minimum and maximum dielectric permittivities of the layered stack and their respective heights.

As such, there is a strong need for substrates for RF waveguides with precisely controllable dielectric properties, especially specific values for their relative permittivity, which do not suffer from the above shortcomings.

SUMMARY

Various embodiments provide a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 120 percent of a skin depth of said RF signals within said electrically conductive material of said conductor layer.

According to Applicant's analysis, this configuration enables to provide a new family of novel dielectric substrates, whose dielectric characteristics can be tailor-made, without the restrictions imposed with conventional multi-layered dielectric substrates. Advantageously, a maximum value of the effective dielectric constant (i.e., the "macroscopic", overall dielectric constant) of the composite substrate medium according to the embodiments is e.g. not limited by the individual dielectric constant of the constituent dielectric substrate (e.g., silicon dioxide), as is the case with conventional multi-layered dielectric substrates. Thus, by controlling a layer thickness of the conductor layer, a desired effective relative permittivity ($\varepsilon_r$) of the composite substrate may be attained.

According to an embodiment, the signal frequency of the RF signals is a frequency of operation of a target system the composite substrate may be used or is to be used with. As an example, the composite substrate according to the embodiments may be used in a micro strip transmission line as a target system, and said micro strip transmission may be provided to transmit RF signals at a certain frequency of operation, e.g. 20 GHz. In this case, as an example, the composite substrate according to the embodiments may be designed in accordance with the principle according to the embodiments considering said operating frequency of 20 GHz as the "frequency of the RF signals" to determine the respective skin depth.

According to further embodiments, if a certain operating frequency range is considered for a target system for the composite substrate, a center frequency of or a frequency value within said certain operating frequency range may be used as said "frequency of the RF signals" to determine the respective skin depth.

As is well known, the skin depth is defined as the depth below the surface of an electric conductor at which a current density has fallen to 1/e, as compared to the current density at its surface. As is also well known, the skin depth may be determined using the following equation:

$$\delta = \sqrt{\frac{2\rho}{\omega\mu}}\sqrt{\sqrt{1+(\rho\omega\varepsilon)^2}+\rho\omega\varepsilon}, \qquad \text{(equation a1)}$$

wherein $\rho$ denotes the resistivity of the electrical conductor, wherein $\omega$ denotes an angular frequency of a signal or current, respectively (with $\omega=2\pi f$, wherein f is the signal frequency), wherein $\mu=\mu_0\mu_r$, wherein $\mu_0$ is the permeability of free space, wherein $\mu_r$ is the relative magnetic permeability of the conductor, wherein $\varepsilon=\varepsilon_0\varepsilon_r$, wherein $\varepsilon_0$ is the permittivity of free space, and wherein $\varepsilon_r$ is the relative permittivity of the conductor.

In some cases, especially for angular frequencies significantly smaller than $$\frac{1}{\rho\varepsilon},$$

equation a1 may also be simplified to:

$$\delta = \sqrt{\frac{2\rho}{\omega\mu}}. \qquad \text{(equation a2)}$$

As an example, using the composite substrate according to the embodiments, waveguides for RF signals may be provided for transmitting RF signals in the range between about 100 MHz to about 200 GHz or above.

According to an embodiment, said layer thickness of said at least one conductor layer is smaller than about 50 percent of said skin depth of said RF signals within said electrically conductive material of said conductor layer.

According to a further embodiment, said layer thickness of said at least one conductor layer ranges between about 2 percent and about 40 percent of said skin depth of said RF signals within said electrically conductive material of said conductor layer.

Further embodiments feature a composite substrate for a waveguide for RF signals wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 7.8 μm (micrometer). According to Applicant's analysis, surprisingly, this configuration enables to provide a novel type of composite substrate for RF signal waveguides wherein particularly the effective relative permittivity of the substrate may be precisely controlled. Further surprisingly, the integration of said at least one conductor layer with the layer thickness smaller than about 7.8 μm enables to provide a substrate for waveguides which comprises a comparatively large relative permittivity, which is particularly not limited by the relative permittivity of the first and second layers of the electric material of the conventional substrates.

Further embodiments feature a composite substrate, wherein said layer thickness of said at least one conductor layer is smaller than about 100 nm.

Further embodiments feature composite substrate, wherein said layer thickness of said at least one conductor layer is greater than about 2 percent of an aggregated layer thickness of said at least first and second layers of dielectric material. According to Applicant's analysis, with this configuration, the effective relative permittivity of the composite substrate may be increased, even significantly increased, as compared to a conventional multilayered configuration of several electrically layers, i.e. without the conductor layer.

According to further embodiments, if more than one conductor layer is provided, it is proposed that an aggregated conductor layer thickness of said conductor layers is greater than about 2 percent of said aggregated layer thickness of said at least first and second layers of dielectric material. In the present embodiment, aggregated layer thickness denotes the resulting thickness that is obtained as a sum of the thicknesses of the individual layers of the material of the same type (i.e., conductive or dielectric). As an example, if two conductor layers are present in the proposed composite substrate, the aggregated conductor layer thickness corresponds to the sum of the individual thicknesses of said conductor layers. Similarly, if 3 dielectric layers are present in a proposed composite substrate, the aggregated layer thickness of the electric material corresponds to the sum of the individual thicknesses of said dielectric material layers.

Further embodiments feature a composite substrate, wherein said at least one conductor layer comprises at least one of the following materials: copper, silver, aluminium, gold, nickel. It is to be noted that these conductor materials relate to exemplary embodiments. According to further embodiments, other conductor materials may also be used for forming said at least one conductor layer.

Further embodiments feature a composite substrate, wherein a layer thickness of said first layer of dielectric material and/or said second layer of dielectric material ranges between about 5 nm to about 1000 nm. According to further embodiments, said layer thickness of said first layer of dielectric material and/or said second layer of dielectric material is not limited to the aforementioned range, but may comprise other values. According to some embodiments, silicon dioxide may be used as dielectric material. According to further embodiments, e.g. aluminum oxide may be used as dielectric material. According to further embodiments, ceramic material may be used as dielectric material. It is to be noted that the disclosure is not limited to these exemplarily listed dielectric materials. According to further embodiments, other dielectric materials may also be used for forming dielectric layers.

According to further embodiments, a layer thickness of said first layer of dielectric material and/or said second layer of dielectric material (or optionally provided further layer(s) of dielectric material) is smaller than about 120 percent of a of a skin depth of said RF signals within said electrically conductive material of said conductor layer. As an example, for the determination of the skin depth at the respective signal frequency of said RF signals, for determining the dielectric layer thickness as defined above, the comments further above related to an operating frequency range of a target system may be used.

Further embodiments feature a waveguide for RF signals comprising a composite substrate according to the embodiments, a first conductor arranged on a first surface of said composite substrate, and a second conductor arranged on a second surface of said composite substrate. As an example, said waveguide may be configured as a micro strip transmission line, wherein said first conductor is a signal conductor, and wherein said second conductor represents a ground plane of said micro strip transmission line.

Advantageously, the field of application of the composite substrate according to the embodiments is not limited to being used within micro strip or other RF transmission line configurations. Rather, the composite substrate according to the embodiments may be used in any target system, wherein a dielectric substrate is required the relative permittivity of which can be tuned or controlled in the sense of the embodiments.

Further embodiments feature a method of manufacturing a composite substrate for a waveguide for RF signals having a signal frequency, wherein said method comprises the following steps: providing a first layer of dielectric material, providing a second layer of dielectric material, and providing at least one conductor layer of an electrically conductive material arranged between said first layer and said second layer, wherein a layer thickness of said at least one conductor layer is smaller than about 120 percent of a skin depth of said RF signals within said electrically conductive material of said conductor layer. It is to be noted that the sequence of method steps does not necessarily correspond to the aforementioned sequence. As an example, at first, a first dielectric layer may be provided, and subsequently, said conductor layer may be provided on top of said first dielectric layer, and subsequently, a second dielectric layer may be provided on top of said conductor layer. Other sequences are also possible according to further embodiments.

According to some embodiments, preferably prior to providing the layers, a frequency range or a center frequency may be determined depending on the frequencies of RF signals the composite substrate is to be used for, and depending on said frequency range or said center frequency, respectively, the layer thickness of at least one of said dielectric layers may be chosen. It may also be beneficial to consider said frequency range or center frequency for determining the layer thickness of said at least one conductor layer, as the skin depth within said conductor material depends on the signal frequency.

In other words, according to a preferred embodiment, in a first step, the frequency range or center frequency of a target system (e.g., microstrip line) into which the composite substrate according to the embodiments is to be integrated, may be determined. Optionally, specific material for the at least one conductor layer (and optionally also for the dielectric layers) may also be chosen, for example copper. Depending on this, the skin depth of RF signals within said frequency range or at said center frequency within said conductor material may be determined, e.g. by using equation a1 or equation a2 as presented above. After this, a layer thickness for the conductor layer may be determined according to some embodiments, and the composite substrate according to the embodiments may be formed by providing said first layer of dielectric material, said second layer of dielectric material and said at least one conductor layer with a specified thickness as determined above.

According to an example, the following manufacturing methods and techniques may be used to provide the composite substrate: Dielectric and/or metal layers may be deposited and patterned using standard semiconductor processing techniques. Deposition can be performed using techniques such as, but not limited to: chemical vapor deposition, e-beam evaporation, sputter deposition, electroplating, etc. Layers may be patterned using lithographically techniques then plasma or wet etched, or deposition and lift-off, etc.

Further embodiments feature a method of manufacturing a composite substrate for a waveguide for RF signals having a signal frequency, wherein said method comprises the following steps: providing a first layer of dielectric material with a predetermined first layer thickness, providing a second layer of dielectric material with a predetermined second layer thickness, and providing at least one conductor layer of an electrically conductive material arranged between said first layer and said second layer, wherein a layer thickness for said at least one conductor layer is determined depending on the following equation: h_2=(h_11+h_12)*(re(epsilon_eff)/re(epsilon_1)), wherein h_2 is said layer thickness of said at least one conductor layer, wherein h_11 is said first layer thickness, wherein h_12 is said second layer thickness, wherein re(epsilon_eff) is the real part of the desired effective permittivity for said composite substrate, wherein re(epsilon_1) is the real part of the permittivity of said first layer of said dielectric material and said second layer of said dielectric material.

Further embodiments feature a method of manufacturing a composite substrate for a waveguide for RF signals, wherein said method comprises the following steps: providing a first layer of dielectric material, providing a second layer of dielectric material, and providing at least one conductor layer of an electrically conductive material arranged between said first layer and said second layer, wherein a layer thickness of said at least one conductor layer wherein a layer thickness of said at least one conductor layer is smaller than about 7.8 μm.

Further advantageous embodiments are provided by the dependent claims.

BRIEF DESCRIPTION OF THE FIGURES

Further features, aspects and advantages of the illustrative embodiments are given in the following detailed description with reference to the drawings in which:

FIG. 8 depicts a table comprising dielectric permittivities according to an embodiment.

DESCRIPTION OF THE EMBODIMENTS

Figure 1:
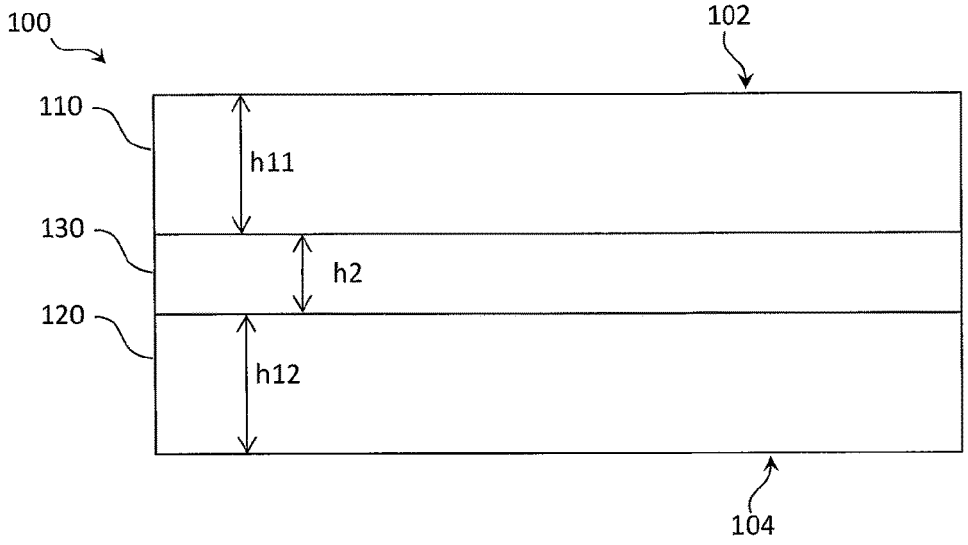
FIG. 1 schematically depicts a front view of a composite substrate according to an embodiment, FIG. 2 schematically depicts a front view of a waveguide for radio frequency signals according to an embodiment, FIG. 3 schematically depicts a side view of the composite substrate according to FIG. 1, FIG. 4 schematically depicts a simplified flow-chart of a method according to an embodiment, FIG. 5A schematically depicts a relative dielectric constant over frequency according to an embodiment, FIG. 5B schematically depicts a loss tangent over frequency according to an embodiment, FIG. 6 schematically depicts a front view of a composite substrate according to a further embodiment, FIG. 7 schematically depicts a front view of a conventional multi-layered substrate.

FIG. 1 schematically depicts a front view of a composite substrate 100 for a waveguide for radio frequency, RF, signals. The composite substrate 100 comprises a first layer 110 of dielectric material, a second layer 120 of dielectric material, and at least one conductor layer 130 of an electrically conductive material arranged between said first layer 110 and said second layer 120. A layer thickness h2 of said at least one conductor layer 130 is smaller than about 120% of a skin depth of said RF signals within said electrically conductive material 130 of said conductor layer. This advantageously enables to provide a composite substrate 100 with an effective relative permittivity that may be controlled within a comparatively large range of values, as opposed to conventional multilayer substrates, which comprise a plurality of dielectric layers. Also, advantageously, a maximum value of the effective relative permittivity for said composite substrate 100 is not limited by the properties of the dielectric material layers, as with conventional substrates, but may rather be influenced by altering the properties of the conductor layer 130.

Figure 2:
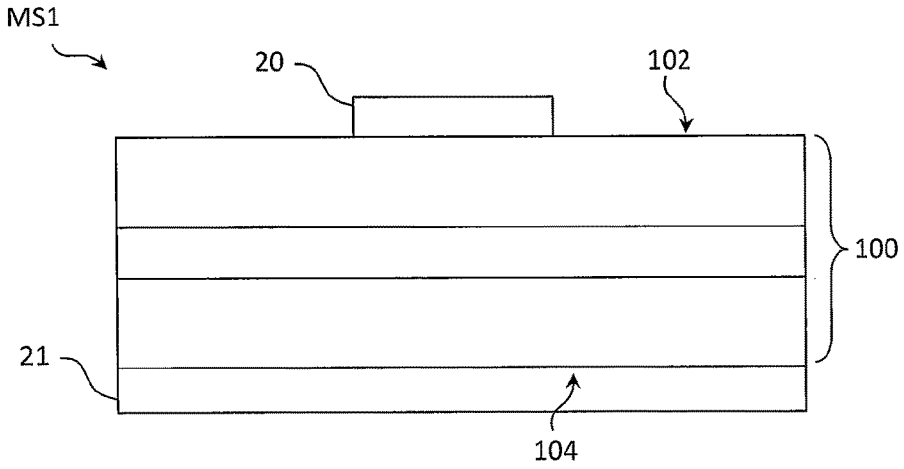

FIG. 2 schematically depicts a front view of a waveguide MS1 for RF signals according to an embodiment. Presently, the waveguide MS1 is configured as a microstrip transmission line, which comprises a first conductor 20 arranged on a first surface 102 (e.g., a top surface in FIG. 2) of said composite substrate 100, and a second conductor 21, which is arranged on an opposing second surface 104 (e.g., a bottom surface in FIG. 2). The first conductor 20 may form a signal conductor as well known in the art, and the second conductor 21 may form a ground plane, as also well known in the art. As the dielectric properties, particularly the relative permittivity, of the composite substrate 100 according to the embodiments may be flexibly and precisely configured in a vast range of values, the microstrip waveguide MS1 may flexibly be adapted to the desired field of application. Particularly, by controlling the relative permittivity of the composite substrate 100 employed within the waveguide MS1 according to FIG. 2, the characteristic impedance of said waveguide MS1 may also be flexibly configured in accordance with the principles of the embodiments.

Returning to FIG. 1, according to preferred embodiments, the layer thickness h2 of the conductor layer 130 may be smaller than about 50% of the skin depth of the RF signals within said electrically conductive material of said conductor layer 130. According to further embodiments, said layer thickness h2 may even range between about 2% and about 40% of the skin depth of the RF signals within said electrically conductive material of said conductor layer 130.

As an example, if the composite substrate 100 according to FIG. 1 is to be provided for a microstrip transmission line MS1 as exemplarily depicted by FIG. 2, and if said microstrip transmission line MS1 is to be used for transmission of RF signals at the frequency of 1 GHz (gigahertz), further assuming that copper is used as conductive material for the conductor layer 130 (FIG. 1), the skin depth of said 1 GHz RF signals within said copper material may be determined to approximately 2.06 μm. According to an exemplary embodiment, the layer thickness h2 is hence chosen as 120%*2.06 μm=2.472 μm. According to a further exemplary embodiment, the layer thickness h2 may be chosen as 10%*2.06 μm=0.206 μm=206 nm (nanometer). Of course, according to further embodiments, other values for the layer thickness may be provided.

According to further exemplary embodiments, the layer thickness h2 for the conductor layer 130 may be chosen to about 10% of the respective skin depth.

Figure 3:
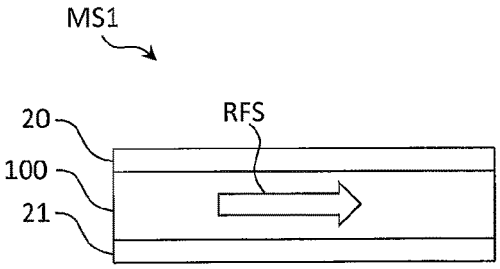

FIG. 3 schematically depicts a side view of the microstrip transmission line MS1 according to FIG. 2. From the side view, the first conductor 20 and the ground plane conductor 21 can be identified, as well as the composite substrate 100 according to the embodiments arranged therebetween. Also indicated in FIG. 3 in the form of a block arrow is a radio frequency signal RFS, which may e.g. comprise a signal frequency of about 2 GHz.

Generally, by employing the principle according to the embodiments, composite substrates 100 suitable for RF signals within a frequency range of about 100 MHz (megahertz) to about 200 GHz or above may be provided.

According to a further embodiment, the layer thickness h2 of the conductor layer 130 (FIG. 1) may be smaller than about 7.8 μm, which yields suitable results for the effective relative permittivity for a wide frequency range of RF signals.

Further particularly preferred embodiments propose to provide a layer thickness h2 of said at least one conductor layer 130 of less than about 100 nm.

According to further embodiments, a layer thickness h11 of said first layer 110 (FIG. 1) of dielectric material ranges between about 5 nm to about 1000 nm. According to further embodiments, a layer thickness h12 of said second layer 120 (FIG. 1) of dielectric material ranges between about 5 nm to about 1000 nm.

According to some embodiments, at least two layers 110, 120 of dielectric material of said composite substrate 100 may comprise identical or at least similar thickness values, i.e. h11=h12.

According to further embodiments, at least two layers 110, 120 of dielectric material of said composite substrate 100 may comprise different thickness values h11, h12.

Further embodiments propose that a layer thickness h2 (FIG. 1) of said at least one conductor layer 130 is greater than about 2 percent of an aggregated layer thickness of said at least first and second layers 110, 120 of dielectric material. According to Applicant's analysis, for this thickness range of the conductor layer 130, a significant modification of the effective relative permittivity of the composite substrate 100 may be attained. For example, if said conductor layer 130 comprises a thickness greater than about 30% of the aggregated layer thickness of said dielectric layers 110, 120, the effective relative permittivity of the composite substrate 100 so obtained may even be further increased. According to other embodiments, however, the layer thickness h2 of the conductor layer 130 may preferably not exceed 120 percent of the skin depth for a considered RF signal frequency and a specific conductor material, as mentioned above.

According to further embodiments, however, the layer thickness h2 of the conductor layer 130 may exceed 120 percent of the skin depth for a considered RF signal frequency and a specific conductor material.

As an example, if said dielectric layers 110, 120 both comprise a layer thickness of 20 nm, the aggregated layer thickness of said dielectric layers 110, 120 amounts to 40 nm. According to the present embodiment, the layer thickness h2 is proposed to be greater than about 2% of 40 nm, i.e. h2>0.8 nm.

According to further embodiments, more than one conductor layer may be provided for the composite substrate. This is exemplarily depicted by the further embodiment 100*a* according to FIG. 6.

The composite substrate 100*a* comprises a first (i.e., top) layer 110 of dielectric material, and a second (i.e., bottom) layer 120 of dielectric material, similar to the configuration 100 of FIG. 1. In contrast to FIG. 1, however, the composite substrate 100*a* according to FIG. 6 comprises at least two conductor layers 131, 132, wherein at least one further dielectric layer 140 is provided between said at least two conductor layers 131, 132.

Bracket 150 indicates that according to further embodiments further conductor layers and/or further dielectric layers may also be provided within the composite substrate 100*a*.

According to a preferred embodiment, when providing a composite substrate with more than three layers, as depicted by FIG. 6, preferably additional layers are added such that for each additional conductor layer 132, a further dielectric layer 140 arranged adjacent to said further conductor layer 132 is provided. However, according to further embodiments, this is not necessarily the case. In other words, according to further embodiments, two or more conductor layers may also be arranged within a composite substrate directly adjacent to each other. Similarly, according to further embodiments, two or more dielectric layers may also be arranged within a composite substrate directly adjacent to each other. This also applies to the top and bottom layers. In other words, adjacent to the dielectric layer 110 and/or to the bottom dielectric layer 120, further dielectric layers may be provided, instead of directly placing a conductor layer adjacent to said first layer 110 and/or said second layer 120.

According to a further preferred embodiment, if more than one conductor layer 131, 132 is provided, cf. e.g. FIG. 6, an aggregated conductor layer thickness h21+h22 of said conductor layers 131, 132 is proposed to be greater than about 2 percent of said aggregated layer thickness h11+h12+h13 of said at least first and second layers 110, 120 (presently there are three dielectric layers 110, 120, 140, and hence the aggregated layer thickness of said dielectric layers amounts to h11+h12+h13) of dielectric material.

According to further embodiments, said at least one conductor layer comprises at least one of the following materials: copper, silver, aluminium, gold, nickel, etc. (other conductor materials or metal materials are also possible according to further embodiments). According to some embodiments, it is also possible to use different of said aforementioned or even other electrically conductive materials for providing the respective conductor layers 131, 132.

When providing composite substrates according to such embodiments which consider a skin depth of RF signals within conductive layers 130, 131, 132, the respective resistivity or conductivity of the used electrically conductive material may be considered for determining the skin depth, as well as the frequency (or center frequency) of said RF signals.

Figure 4:
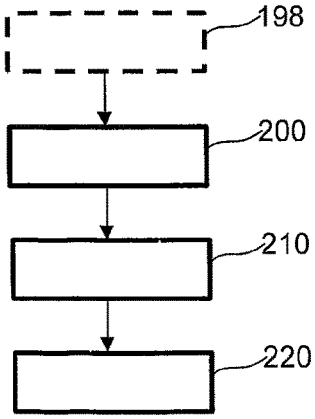

FIG. 4 schematically depicts a simplified flow-chart of a method according to an embodiment. Said method comprises the following steps: providing 200 a first layer 110 (FIG. 1) of dielectric material, providing 210 a second layer 120 of dielectric material, and providing 220 at least one conductor layer 130 of an electrically conductive material arranged between said first layer 110 and said second layer 120, wherein a layer thickness of said at least one conductor layer 130 is smaller than about 120 percent of a skin depth of said RF signals within said electrically conductive material of said conductor layer 130. As already mentioned above, another sequence of the providing steps 200, 210, 220 may also be considered, for example first providing said second dielectric layer 120 as a bottom layer of the composite substrate, then providing said at least one conductor layer 130 on a top surface of said second dielectric layer 120, then providing said first dielectric layer 110 on a top surface of said conductor layer 130. Other sequences of the providing steps are also possible according to further embodiments.

According to a preferred embodiment, preferably prior to any of the providing steps 200, 210, 220, a further, optional, step 198 may be performed, which comprises determining a frequency range or a center frequency depending on the frequencies of RF signals the composite substrate 100, 100*a* to be manufactured is to be used for, and, optionally, depending on said frequency range or said center frequency, respectively, the layer thickness of at least one of said dielectric layers may be chosen. Also optionally, in said step 198, said frequency range or center frequency may be considered for determining the layer thickness of said at least one conductor layer, as the skin depth within said conductor material depends on the signal frequency.

In other words, according to a preferred embodiment, in said optional step 198, the frequency range or center frequency of a target system (e.g., microstrip line MS1) into which the composite substrate 100 according to the embodiments is to be integrated, may be determined. Optionally, a specific material for the at least one conductor layer 130 may also be chosen, for example copper. Depending on this, the skin depth of RF signals RFS within said frequency range or at said center frequency within said conductor material may be determined, e.g. by using equation a1 or equation a2 as presented above. After this, a layer thickness for the conductor layer may be determined according to the embodiments, and the composite substrate according to the embodiments may be formed by providing said first layer of dielectric material, said second layer of dielectric material and said at least one conductor layer with a specified thickness as determined above.

According to further embodiments, the determination of a layer thickness for the conductor layer 130 may also be performed within the associated step 220 of providing said conductor layer. As an example, prior to said step 220, said dielectric layers 110, 120 may be provided, and at that stage it is not necessary to already provide or determine the layer thickness of the conductor layer 130.

According to a further particularly preferred embodiment, a layer thickness of at least one dielectric layer 110, 120 or an aggregated layer thickness of some or all dielectric layers 110, 120, 140 of the composite substrate 100 is considered when determining the layer thickness of said conductor layer 130.

Some embodiments feature a method of manufacturing a composite substrate for a waveguide for RF signals having a signal frequency, wherein said method comprises the following steps: providing 200 a first layer 110 of dielectric material with a predetermined first layer thickness h11, providing 210 a second layer 120 of dielectric material with a predetermined second layer thickness h12, and providing 220 at least one conductor layer 130 of an electrically conductive material arranged between said first layer 110 and said second layer 120, wherein a layer thickness h2 for said at least one conductor layer 130 (FIG. 1) is determined depending on the following equation: h_2=(h_11+h_12)*(re(epsilon_eff)/re(epsilon_1)), wherein h_2 is said layer thickness (h2) of said at least one conductor layer 130, wherein h_11 is said first layer thickness h11, wherein h_12 is said second layer thickness h12, wherein re(epsilon_eff) is the real part of the desired effective permittivity for said composite substrate 100, wherein re(epsilon_1) is the real part of the permittivity of said first layer 110 of said dielectric material and said second layer 120 of said dielectric material.

Further embodiments feature a method of manufacturing a composite substrate 100 for a waveguide for RF signals, wherein said method comprises the following steps: providing 200 a first layer 110 of dielectric material, providing 210 a second layer 120 of dielectric material, and providing 220 at least one conductor layer 130 of an electrically conductive material arranged between said first layer 110 and said second layer 120, wherein a layer thickness of said at least one conductor layer 130 is smaller than about 7.8 μm.

Further embodiments propose that said layer thickness h2, h21, h22 of said at least one conductor layer 130, 131, 132 is smaller than about 100 nm.

Further embodiments propose that a layer thickness h11, h12 of said first layer 110 of dielectric material and/or said second layer 120 of dielectric material ranges between about 5 nm to about 1000 nm. According to yet further embodiments, other value ranges for the layer thickness h11, h12 of said first layer 110 of dielectric material and/or said second layer 120 of dielectric material are also possible, both inside the abovementioned range and/or outside thereof, and/or overlapping with the abovementioned range.

Further embodiments propose that a plurality of conductor layers 131, 132 and at least one additional layer 140 of dielectric material is provided between said first layer 110 and said second layer.

As already mentioned above, the sequence of method steps of the method of manufacturing a composite substrate according to the embodiments may be changed with respect to each other, wherein it may be preferable to build up a composite substrate 100, 100*a* comprising several layers from a bottom layer to a top layer or vice versa, depending on a specific technique employed for manufacturing.

In the following, aspects of the theory of dielectric substrates and the propagation of electromagnetic waves related to conductors and waveguides MS1 (FIG. 2) comprising composite materials for such waveguides are discussed.

At first, a conventional multi-layered substrate MLS1 as depicted on the left portion of FIG. 7 is considered. As can be seen, up to n many dielectric layers are stacked on top of each other, with each layer defined by its thickness, hi, and its dielectric characteristics, $\varepsilon_{ri}$ and $\tan(\delta_i)$, where i=1, . . . , n.

On the right half of FIG. 7, a front view of a substrate MLS1' is depicted, wherein said substrate MLS1' is single-layered, i.e. consist of a single layer of dielectric material, and has the same macroscopic dielectric characteristics as the multi-layered substrate MLS1. Especially, the effective relative permittivity of the substrate MLS1' is identical to the effective relative permittivity of the multi-layered substrate MLS1.

According to an example, the effective, macroscopic dielectric characteristics of the multilayered dielectric substrate MLS1 of FIG. 7 can be found by the application of Gauss law. Mathematically, the expression for the dielectric constant of this stratified substrate is:

$$\bar{\varepsilon}_{reff} = \frac{\sum_{i=1}^{n} h_i}{\sum_{i=1}^{n} \frac{h_i}{\bar{\varepsilon}_{ri}}} = \frac{h}{\sum_{i=1}^{n} \frac{h_i}{\bar{\varepsilon}_{ri}}} \quad \text{(equation 1)}$$

Where, $$h = \sum_{i=1}^{n} h_i,\ \bar{\varepsilon}_{reff} = \varepsilon'_{reff} - j\varepsilon''_{reff},\ \bar{\varepsilon}_{ri} = \varepsilon'_{ri} - j\varepsilon''_{ri}.$$

The loss tangents corresponding to the complex permittivities are $$\tan(\delta_{eff}) = \frac{\varepsilon''_{reff}}{\varepsilon'_{reff}} \text{ and } \tan(\delta_{ei}) = \frac{\varepsilon''_{ri}}{\varepsilon'_{ri}}.$$

As evident from (equation 1), a combination of substrate layers with different dielectric characteristics and/or substrate heights can give a tailor-made dielectric substrate. However, this conventional solution tends to be costly since it requires a variety of different constituent dielectric materials, which places constraints on their availability. Further, multilayered substrates MLS1 obtained in this way are limited by the obtainable values of the dielectric permittivity which is dictated by the minimum and maximum dielectric permittivities of the stack and their respective heights.

As such, there exists a need for a method that is capable of addressing the above two mentioned shortcomings. This method is provided in form of the embodiments as explained above and as further detailed below.

To further explain the details of the idea behind the embodiments, at first a propagation constant in conductors is considered. According to an embodiment, the expression for the propagation constant in conductors is given below, $$\gamma_m = (1+j)\sqrt{\frac{\omega\mu\sigma}{2}} = (1+j)\frac{1}{\delta}, \quad \text{(equation 2)}$$

where $$\delta = \sqrt{\frac{2}{\omega\mu\sigma}}$$

represents the skin depth, also cf. equation a2 further above. The skin depth stands for the depth below the surface of the conductor at which the current density has dropped to 1/e (0.37) of the value it had at the surface of the conductor. The relationship shown by (equation 2) indicates that a wave propagating in conductors undergoes changes in both its magnitude and its phase. The total change in the propagation characteristics is dependent on the thickness of the metal, i.e.

$$\gamma_t = \gamma_m \cdot d_m \quad \text{(equation 3)},$$

where $d_m$ stands for the thickness of the conductor. As an example, if a conductor has a thickness that is much greater than the skin depth, the electro-magnetic (EM) wave travelling through it, has not only been greatly attenuated, but according to (equation 2) its phase constant has also been greatly affected. As a further example, for practical purposes, conductor thicknesses between 3δ-5δ are sufficient to almost fully attenuate the EM wave. This, however, imposes a question: what happens to the EM wave if the conductor thickness is well below the skin depth, as proposed by the embodiments?

In order to provide a satisfactory answer to this question and an explanation of the principle according to the embodiments, the real part of the equivalent dielectric permittivity of (equation 2) is considered, which can be written as:

$$\varepsilon'_{rm} = \frac{c^2\mu\sigma}{2\omega} \quad \text{(equation 4)}$$

It can be appreciated from (equation 4) that the dielectric permittivity of conductors is not constant, but it depends on various parameters. Namely, it is linearly dependent on conductivity σ and permeability μ, whereas it is inverse linearly dependent on angular frequency. At lower frequencies, the dielectric permittivity for standard conductors is very high. The table as depicted by FIG. 8 summarizes dielectric permittivities obtained using (equation 4) for different metals (silver, copper and aluminium) according to some exemplary embodiments at frequencies of 1 GHz, 5 GHz and 20 GHz.

As seen from this table, the values of the obtained dielectric constants are extremely high. In view of equation (1), according to the embodiments, this may have a tremendous impact on the effective dielectric constant of a multilayered substrate according to the embodiments, without significantly impacting the overall loss tangent. In order to prove this point, in the following a three-layer structure, i.e. composite substrate, similar to FIG. 1 is considered.

The considered structure based on FIG. 1 depicts two dielectric layers 110, 120 "sandwiching" a comparatively thin, preferably sub-skin depth conductor 130. The structure of this figure is used to derive the composite EM propagation characteristics according to the embodiments, from which an effective dielectric characteristic of the medium formed in this way is derived. The composite substrate 100 of FIG. 1 may also be considered as a parallel plate waveguide, PPWG, which, according to an embodiment, may be fully determined by its thickness, whereas for the following considerations (and in this respect deviating from a real composite structure 100 according to the embodiments) its x and y dimensions are assumed to be infinite (x dimension corresponding to a horizontal direction of FIG. 1, and y dimension corresponding to a direction perpendicular to the drawing plane of FIG. 1). According to an embodiment, the final expression for the composite, effective dielectric characteristic is found as the solution of the Helmholtz equation in a source-free medium for TM waves $$\left(\frac{\partial}{\partial x}=0\right)\nabla^2 E+k^2E=0 \text{ for } k=\omega^2\mu\varepsilon. \quad \text{(equation 5)}$$

After a lengthy derivation, the single steps of which are omitted here for the sake of clarity, one obtains the following solution for the effective medium according to the embodiments, composed of two dielectric layers 110, 120 and one thin conductor layer 130.

$$\bar{\varepsilon}_{eff}=\bar{\varepsilon}_1\left[1-\frac{\gamma_m}{h_1\varepsilon_{r2}k_0^2}\tanh(\gamma_m h_2)\right], \quad \text{(equation 6)}$$

Where $$\varepsilon_{r2}=1-j\frac{\sigma^2}{\omega\varepsilon_0}$$

($\varepsilon_0$ being the dielectric permittivity of vacuum) and $k_0$ is the propagation constant in free space, $$k_0=\frac{\omega}{c},$$

with c being the velocity of light.

Figure 5A:
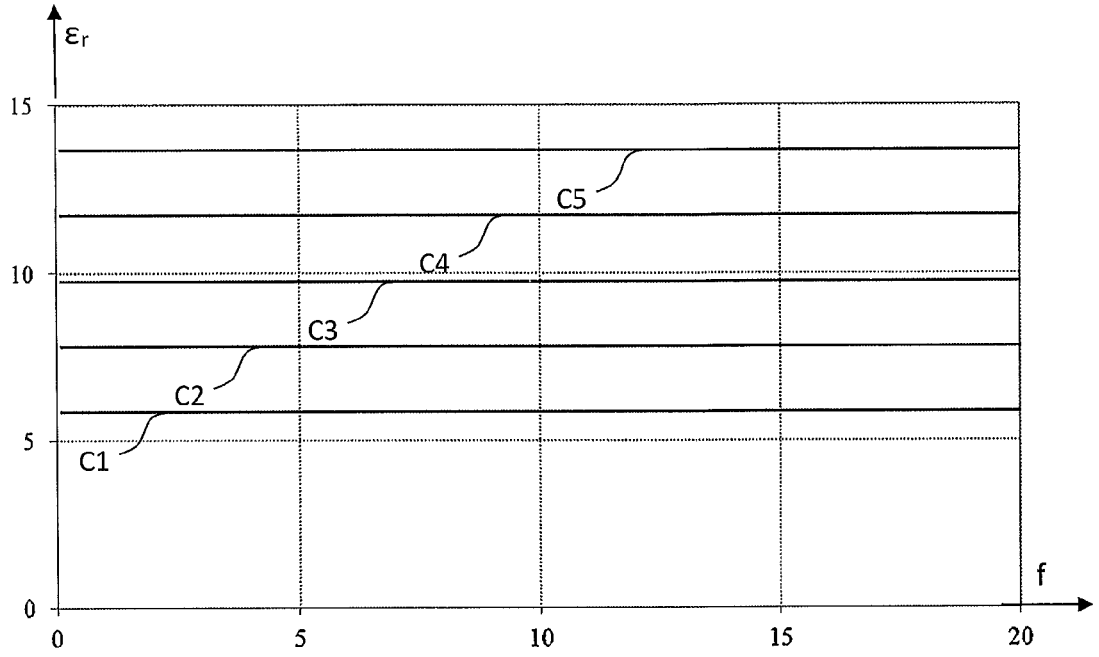

As an example of the possibility to tune the dielectric characteristics using sub-skin depth conductors 130 according to some embodiments, FIG. 5A depicts the obtainable effective dielectric characteristics for the case when the dielectric material for layers 110, 120 is silicon dioxide with $\varepsilon_{rSiO_2}$=3.9, tan($\delta_{SiO_2}$)=1e-3 with a thickness h11, h12 of 10 nm, whereas the thickness h2 of the copper layer 130 is varied from 10 nm to 50 nm. Of course, according to further embodiments, other dielectric materials for the layers 110, 120, 140 may also be used. In addition, according to further embodiments, other conductors may be used for layer 130, e.g. gold, nickel, aluminum or further conductors.

Curve C1 of FIG. 5A depicts the effective dielectric constant over frequency f in GHz of the composite substrate 100 (FIG. 1) for a conductive layer thickness h2 of 10 nm (nanometer). Curve C2 depicts the effective dielectric constant over frequency for a conductive layer thickness h2 of 20 nm, curve C3 for h2=30 nm, curve C4 for h2=40 nm, and curve C5 for h2=50 nm. As evident from FIG. 5A, the dielectric characteristics of the effective multilayered substrate 100 according to the embodiments stay approximately constant in the indicated frequency range. Of importance is the fact that, according to an embodiment, the dielectric characteristics of the effective substrate 100 can be modified e.g. by the modification of the thickness h2 of the conductor layer 130 (FIG. 1), without a significant impact on the loss tangent of the overall, dielectric medium 100.

Figure 5B:
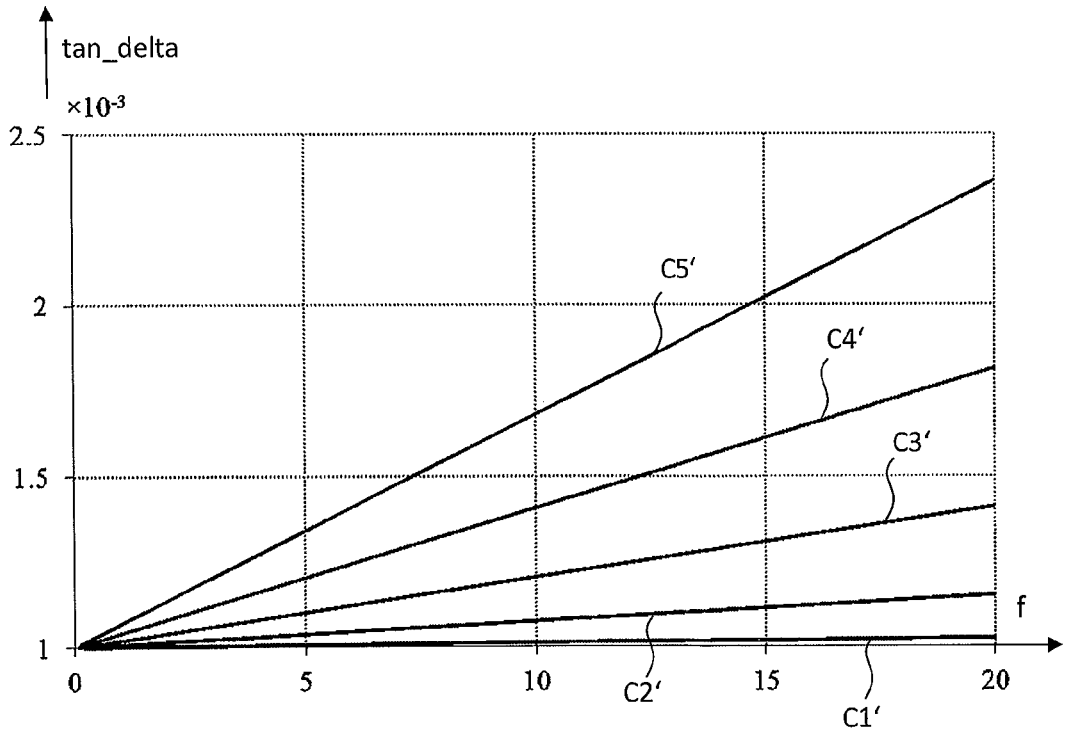

The loss tangent tan_delta over frequency (same scaling as in FIG. 5A) is exemplarily depicted for the above mentioned five conductor thickness values ranging from 10 nm, cf. curve C1' of FIG. 5B, to 50 nm, cf. curve C5' of FIG. 5B.

Further, advantageously, the upper value of the effective dielectric constant of the substrate according to the embodiments is not limited by the dielectric constant of the constituent dielectric substrate (silicon dioxide in this case), as is the case with conventional multilayered dielectric substrate MLS1, cf. FIG. 7. Rather, according to the embodiments, the dielectric constant of the constituent dielectric substrate 110, 120 only dictates the lowest possible value of the effective dielectric constant of the overall composite substrate 100, while its loss tangent can be assumed to be the loss tangent of the overall, proposed effective dielectric substrate.

Hence, the principle according to the embodiments represents a new family of novel dielectric substrates 100, 100*a*, whose dielectric characteristics can be tailor-made, without the restrictions imposed with conventional multilayered dielectric substrates MLS1 of FIG. 7.

According to some embodiments, equation (6) can be further simplified under the assumption that the dielectric loss tangent of the constituent dielectric layer is low—in the present case below 1e-4. In this case, the effective permittivity of the multilayer substrate becomes $$\text{real}(\bar{\varepsilon}_{eff})=\text{real}(\bar{\varepsilon}_1)\left[1+\frac{h_2}{2h_1}\right] \quad \text{(equation 7)}$$

According to these embodiments, the loss tangent of the obtained composite substrate may be substantially equal to the loss tangent of the constituent dielectric substrate 110, 120. Equation (7) as obtained according to some embodiments is important due to the statement it carries: of particular importance to the manipulation of the dielectric characteristics of the composite structure 100 according to some embodiments is the ratio (e.g., $h_2/2h_1$) of thicknesses or cross-sectional areas of the layers 130 and 110, 120, and not the conductivity of the conductor layers 130. This may have significant implications if a need arises for thicker dielectric substrates, since according to further embodiments, cf. FIG. 6, several or many comparatively thin dielectric and conductor layers may be deposited, e.g. sequentially onto each other, until the desired overall substrate thickness is achieved. In these embodiments, the composite dielectric characteristics are determined by the ratio of the total cross-sectional surface areas occupied by the dielectric 110, 120, 140 and the conductor 130.

To summarize, the principle according to the embodiments particularly enables the following aspects:

1. efficient manipulation of dielectric characteristics of a multi-layer substrate 100, 100*a* by using comparatively thin (e.g., sub-skin depth, or ranging up to about 120% of the skin depth) conductors 130.

2. According to Applicant's analysis, the dielectric characteristics of a multi-layered substrate 100 according to some embodiments are mainly dependent on the ratio of the total cross-sectional surface areas (or respective layer thicknesses, if all layers comprise the same width) of the dielectric and conductor, and not of the conductivity of the conductor.

3. According to some embodiments, the thicknesses of the conductor layers may preferably be smaller than 120% of the skin depth, more preferably below skin depth (i.e., smaller than 100% of the skin depth), and according to further embodiments, their thickness (not to be confused with the ratio of the cross-sectional surface areas of the dielectric and conductor) may influence an upper frequency up to which they may be used.

According to a particularly preferred example, an upper frequency of RF signals RFS to be used with the substrate according to the example should be the one at which a conductor thickness h2 is approximately 10% of its skin depth at that particular frequency. As a further particularly preferred example, a copper conductor layer 130 with a thickness h2 of 20 nm may e.g. correspond to 10% a skin depth of 200 nm at 100 GHz.

To summarize, the principle according to the embodiments allows the creation of tailor-made RF substrate 100, 100*a* with low insertion loss (low loss tangent) and arbitrary values of dielectric constants, not limited by the constituent dielectric layers, whereas the existing, conventional multilayered dielectric solutions are limited especially in their capability to produce high values of dielectric constants and low loss tangents. The principle according to the embodiments does not have such a limitation. For example, the loss tangent of the effective, multilayered substrate 100, 100*a* obtained according to the embodiments is that of the constituent dielectric 110, 120 (, 140), whereas its effective dielectric constant is controllable by the thickness h2 (h21, h22) of the conductive layer(s) 130 (, 131, 132).

Also, according to some embodiments, comparatively thick substrate stacks 100*a* may be obtained by providing several or many conductive layers 131, 132 and preferably intermediate dielectric layers 140 therebetween, wherein for the thickness of said conductive layers 131, 132 the aforementioned principles apply.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The invention claimed is:

1. An article of manufacture comprising a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 120 percent of a skin depth of said RF signals within said electrically conductive material of said conductor layer, wherein a layer thickness of said first layer of dielectric material and said second layer of dielectric material ranges between about 5 nm to about 1000 nm.

2. The article according to claim 1, wherein said layer thickness of said at least one conductor layer ranges between about 2 percent and about 40 percent of said skin depth of said RF signals within said electrically conductive material of said conductor layer.

3. The article according to claim 1, wherein said layer thickness of said at least one conductor layer is greater than about 2 percent of an aggregated layer thickness of said at least first and second layers of dielectric material wherein, if more than one conductor layer is provided, an aggregated conductor layer thickness of said conductor layers is greater than about 2 percent of said aggregated layer thickness of said at least first and second layers of dielectric material.

4. The article according to claim 1, wherein said at least one conductor layer comprises at least one of the following materials: copper, silver, aluminum, gold, nickel.

5. The article according to claim 1, wherein a layer thickness of said first layer of dielectric material and said second layer of dielectric material is smaller than about 120 percent of the skin depth of said RF signals within said electrically conductive material of said conductor layer.

6. The article according to claim 1, wherein said layer thickness of said at least one conductor layer is smaller than about 50 percent of said skin depth of said RF signals within said electrically conductive material of said conductor layer.

7. The article of claim 1, wherein the article comprises a transmission line comprising the composite substrate between top and bottom conductor layers.

8. An article of manufacture comprising a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than 100 nm, wherein said layer thickness of said at least one conductor layer is greater than about 2 percent of an aggregated layer thickness of said at least first and second layers of dielectric material.

9. The article according to claim 8, wherein the composite substrate comprises more than one conductor layer, an aggregated conductor layer thickness of said conductor layers is greater than about 2 percent of said aggregated layer thickness of said at least first and second layers of dielectric material.

10. The article according to claim 8, wherein said at least one conductor layer comprises at least one of the following materials: copper, silver, aluminum, gold, nickel.

11. The article according to claim 8, wherein the aggregated layer thickness of said first layer of dielectric material and said second layer of dielectric material ranges between about 5 nm to about 1000 nm.

12. The article according to claim 8, wherein the aggregated layer thickness of said first layer of dielectric material and said second layer of dielectric material is smaller than about 120 percent of the skin depth of said RF signals within said electrically conductive material of said conductor layer.

13. The article of claim 8, wherein the article comprises a transmission line comprising the composite substrate between top and bottom conductor layers.

14. A method of manufacturing an article of manufacture comprising a composite substrate for a waveguide for radio frequency signals having a signal frequency, wherein said method comprises providing a first layer of dielectric material, providing a second layer of dielectric material, and providing at least one conductor layer of an electrically conductive material arranged between said first layer and said second layer, wherein a layer thickness of said at least one conductor layer is smaller than about 100 nm; and wherein a layer thickness of said first layer of dielectric material and second layer of dielectric material ranges between about 5 nm to about 1000 nm.

15. The method according to claim 14, further comprising providing a plurality of conductor layers and at least one additional layer of dielectric material between said first layer and said second layer.

16. The method of claim 14, further comprising providing the composite substrate between top and bottom conductor layers to form a transmission line of the article.

17. An article of manufacture comprising a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 120 percent of a skin depth of said RF signals within said electrically conductive material of said conductor layer; and wherein said layer thickness of said at least one conductor layer is greater than about 2 percent of an aggregated layer thickness of said at least first and second layers of dielectric material wherein, if more than one conductor layer is provided, an aggregated conductor layer thickness of said conductor layers is greater than about 2 percent of said aggregated layer thickness of said at least first and second layers of dielectric material.

18. The article of claim 17, wherein the article comprises a transmission line comprising the composite substrate between top and bottom conductor layers.

19. An article of manufacture comprising a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than about 120 percent of a skin depth of said RF signals within said electrically conductive material of said conductor layer; and wherein a layer thickness of said first layer of dielectric material and said second layer of dielectric material is smaller than about 120 percent of the skin depth of said RF signals within said electrically conductive material of said conductor layer.

20. The article of claim 19, wherein the article comprises a transmission line comprising the composite substrate between top and bottom conductor layers.

21. An article of manufacture comprising a composite substrate for a waveguide for radio frequency signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than 100 nm; and wherein a layer thickness of said first layer of dielectric material and said second layer of dielectric material ranges between about 5 nm to about 1000 nm.

22. The article of claim 21, wherein the article comprises a transmission line comprising the composite substrate between top and bottom conductor layers.

23. An article of manufacture comprising a composite substrate for a waveguide for radio frequency, RF, signals having a signal frequency, wherein said composite substrate comprises at least a first layer of dielectric material and a second layer of dielectric material, and at least one conductor layer of an electrically conductive material arranged between said first layer and said second layer, wherein a layer thickness of said at least one conductor layer is smaller than 100 nm; and wherein a layer thickness of said first layer of dielectric material and said second layer of dielectric material is smaller than about 120 percent of a skin depth of said RF signals within said electrically conductive material of said conductor layer.

24. The article of claim 23, wherein the article comprises a transmission line comprising the composite substrate between top and bottom conductor layers.

* * * * *